US005395160A

United States Patent [19]

Krebs et al.

[11] Patent Number: 5,395,160

[45] Date of Patent: Mar. 7, 1995

[54] ARMREST ASSEMBLY FOR A DENTAL CHAIR

[75] Inventors: Paul B. Krebs, Newberg; Thomas E. Brink, Dallas, both of Oreg.

[73] Assignee: A-Dec, Inc., Newberg, Oreg.

[21] Appl. No.: 929,094

[22] Filed: Aug. 13, 1992

[51] Int. Cl.[6] ..... A47C 7/54

[52] U.S. Cl. ..... 297/411.2; 297/115; 297/411.3; 297/411.39

[58] Field of Search ..... 297/411, 417, 115

[56] References Cited

U.S. PATENT DOCUMENTS

| | | | |
|---|---|---|---|
| D. 333,736 | 3/1993 | Nordstrom | D6/361 |
| 2,985,226 | 5/1961 | Maurer et al. | 297/116 |
| 3,025,108 | 3/1962 | Teague, Jr. | 297/411 X |
| 3,116,093 | 12/1963 | Bosack | 297/115 X |
| 3,142,509 | 7/1964 | Ehrke et al. | 297/82 |
| 3,357,740 | 12/1967 | Vaughn et al. | 297/416 |
| 3,414,324 | 7/1968 | Taylor et al. | 297/90 |
| 3,427,072 | 2/1969 | Hale | 297/342 |
| 3,666,319 | 5/1972 | Moloney, Jr. | 297/411 X |
| 3,774,965 | 11/1973 | Brandt et al. | 297/417 |
| 3,829,159 | 8/1974 | Leffler | 297/417 |
| 4,141,586 | 2/1979 | Goldner et al. | 297/191 |
| 4,173,372 | 11/1979 | Norris | 297/345 |
| 4,176,878 | 12/1979 | Koutsky | 297/115 |
| 4,244,623 | 1/1981 | Hall et al. | 297/411 X |
| 4,400,033 | 8/1983 | Pietsch | 297/115 X |
| 4,541,671 | 9/1985 | Broadhead et al. | 297/330 |
| 4,621,864 | 11/1986 | Hill | 297/411 X |
| 4,881,778 | 11/1989 | Stephenson et al. | 297/417 |
| 4,886,317 | 12/1989 | Konzmann et al. | 297/417 |
| 4,966,413 | 10/1990 | Palarski | 297/330 |
| 4,968,095 | 11/1990 | Moyer | 297/417 |
| 4,978,170 | 12/1990 | Pelz et al. | 297/411 |
| 5,190,349 | 3/1993 | Austin, Jr. et al. | 297/316 |

FOREIGN PATENT DOCUMENTS

| | | | |
|---|---|---|---|
| 0310355 | 4/1989 | European Pat. Off. . | |
| 2045120 | 2/1971 | France | 297/301 |
| 889966 | 9/1953 | Germany . | |
| 2157291 | 1/1973 | Germany . | |
| 2226572 | 12/1973 | Germany . | |

OTHER PUBLICATIONS

Takara Belmont 50-page Japanese language dental equipment catalog, cover and pp. 26-29, circa Jan. 1991.

A-Dec 117-page equipment catalog, cover and pp. 21-38, Jan. 1991.

Signo "Grand" 19-page Japanese language brochure, cover, pp. 1-16, circa Jan. 1991.

A-Dec "J-Dec" two-page Japanese language brochure circa Jan. 1991.

Pelton and Crane one-page brochure circa Jan. 1991.

Tecnodent two-page brochure, circa Jan. 1991.

Planmeca Oy eight-page "PM 2002 CC" brochure, circa Jan. 1989.

A-Dec "Decade 1015 Chair" eight-page brochure, pp. 1, 3, circa Jan. 1990.

Osada "FX Series" 31-page Japanese language brochure, cover and pp. 1-16, circa Jan. 1991.

Ampco Dental Products four-page brochure, cover only, circa Jan. 1991.

Takara Belmont 36-page Japanese language brochure, cover and pp. 16-24, circa Jan. 1991.

Siemens 27-page catalog, cover and p. 16, Feb. 1991.

KaVo "Systematica® 1060" four-page French language brochure, circa Jan. 1991.

Belmont "SP-Six" ten-page brochure, pp. 1-10, Aug., 1985.

Elan 2000 III 20-page Japanese language catalog, cover and pp. 1-3, circa Jan. 1991.

Belmont "Pro II" eight-page brochure, pp. 1-8, circa Jan. 1991.

Royal Dental "Royal" two-page brochure, circa Jan. 1991.

English language abstract of German patent No. 2 226 572 (stapled to patent).

*Primary Examiner*—Peter M. Cuomo

*Assistant Examiner*—Suzanne L. Dino

*Attorney, Agent, or Firm*—Klarquist Sparkman Campbell Leigh & Whinston

[57] ABSTRACT

A dental chair has an armrest pivoted to a base at an armrest pivot, and a seat back pivoted to the base at a back pivot located forward of the armrest pivot. The seat back includes a support pin for supporting the armrest at a position forward of the seat back pivot. Moving the seat back from an upright position to a reclined position through a large range of angular motion causes the support pin to elevate the armrest by a substantially smaller angular amount.

19 Claims, 4 Drawing Sheets

ARMREST ASSEMBLY FOR A DENTAL CHAIR

This invention relates to an armrest assembly used with a dental chair.

BACKGROUND AND SUMMARY OF THE INVENTION

Reclining chairs are commonly used for treatment of dental patients. Normally, a patient enters the chair while the seat back is in an upright position. Treatment is usually provided with the seat back reclined so that the patient is in a recumbent position. Armrests provide the patient with comfortable handhold and a feeling of security. The patient's movement on or off the chair can be facilitated by armrests that can be moved out of position to permit a patient to enter the chair from the side. A manually pivoting armrest of this type is disclosed in co-pending U.S. patent application No. 07/501,674, now U.S. Pat. No. 5,190,349.

To reduce the risk of exposing a patient to contamination or infection, all surfaces requiring manual contact by dental personnel should be disinfected or sterilized. Thus, all manual adjustment controls should be disinfected regularly.

It is an object of the present invention to provide a dental chair having armrests that permit a patient to move on and off the chair from the side, and which armrests are raised on each side of the patient when the chair is in a reclined position.

It is an additional object of the invention to provide a dental chair with armrests that are automatically positioned with chair movement and that do not require operator contact for adjustment or actuation.

It is a further object of the invention to provide a dental chair in which the armrests also can be manually moved, independent of the chair and regardless of the seat back position, to facilitate cleaning.

It is yet another object of the invention to provide a dental chair with armrests that allow the seat back to be easily foldable forward into a more compact shipping package.

The present invention achieves the above objects by providing a dental chair which has a seat that includes a base, with a pair of armrests that are pivotally attached to the base to move between a lowered position and a raised position. The upper surfaces of the armrests are flush with the surface of the seat when in the lowered position. A seat back is pivotally attached to the base at a pivot point forward of the armrest pivot attachment. The seat back is movable between an upright position and a reclined position. The seat back includes a support pin positioned forward of the seat back pivot for supporting the armrest and for elevating it as the seat back reclines. The seat back pivot is located forward of the armrest pivot so that as the seat back moves through a relatively large angle in moving from the upright to the reclined position, the armrest elevates by a relatively limited angular amount to the raised position.

DETAILED DESCRIPTION OF A PREFERRED EMBODIMENT

Figure 1:
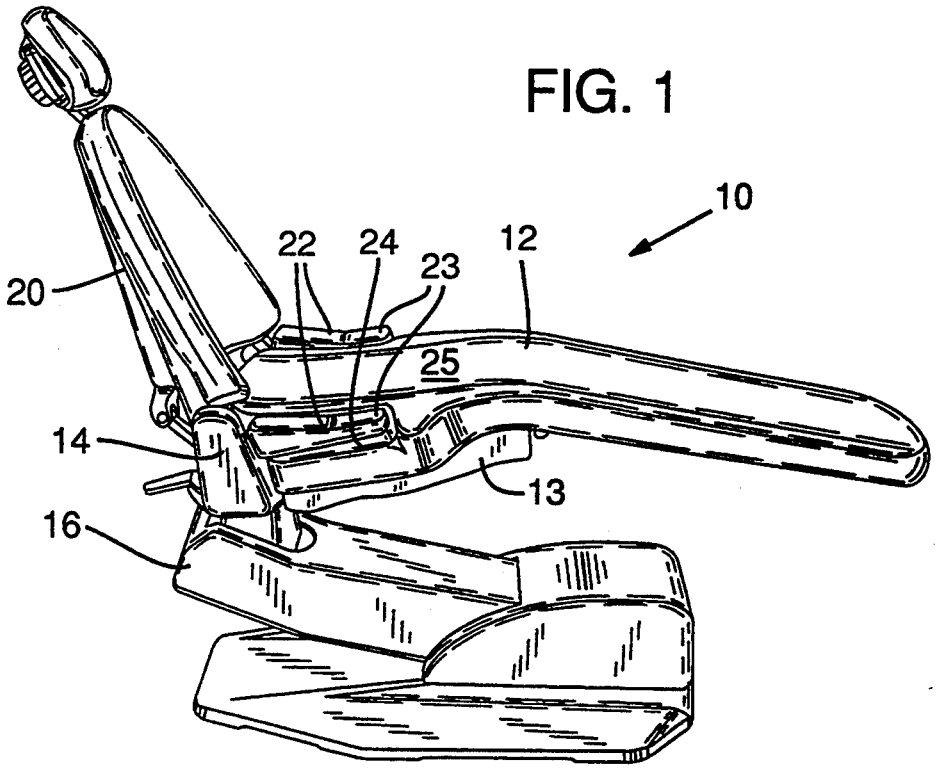
FIG. 1 is a perspective view of a dental chair that incorporates an armrest assembly according to the present invention.

FIG. 1 shows a dental chair 10 that incorporates an armrest assembly according to a preferred embodiment. The chair includes a seat 12 and seat back 20. The seat 12 is mounted to a base 13 that includes a pair of members 14. The base members 14 protrude upwardly on each rearward side of the seat 12. The seat 12 and base members 14 are carried on an adjustable pedestal 16. The seat back 20 is pivotally attached to each of the base members 14. An armrest 22 is pivotally attached to each base member 14 and extends forwardly therefrom. In the upright position (FIG. 1), each armrest rests in a recess 24 that is defined on each side of the seat 12 in the vicinity of the armrest. This armrest position is referred to as the lowered position. In the lowered position, the top surfaces 23 of the armrests are generally flush with the upper surface 25 of the seat to facilitate a patient's movement over the armrests 22 as the patient enters and exits the chair from the side.

Figure 2:
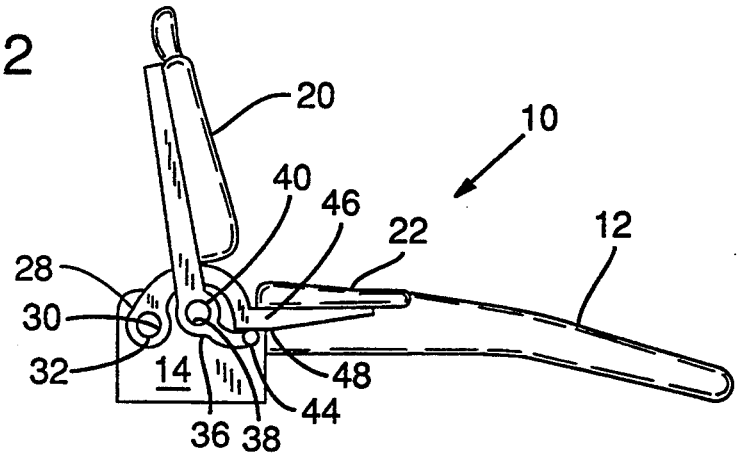
FIG. 2 is a schematic side view of the embodiment of FIG. 1 showing the seat back in an upright position and the armrest in a lowered position.
Figure 3:
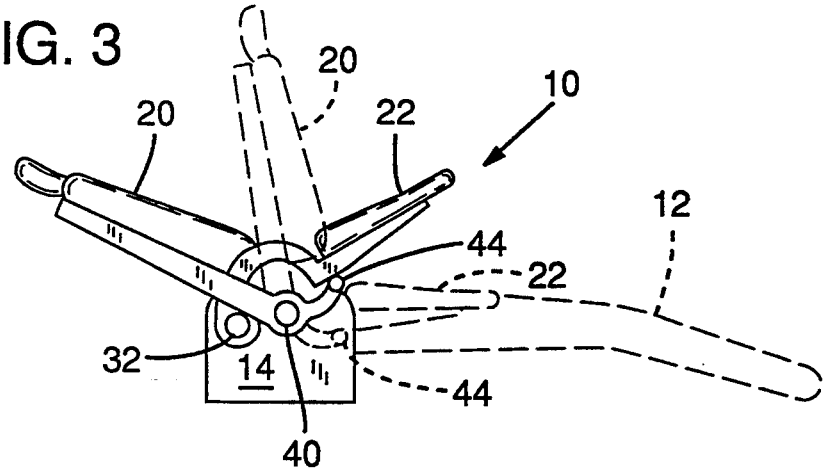
FIG. 3 is a schematic side view of the embodiment of FIG. 1 showing the seat back in a reclined position and the armrest in a raised position.

As the seat back moves from the upright (FIG. 2) to the reclined (FIG. 3) position, the armrests 22 automatically move from the lowered to a raised position. FIGS. 2 and 3 schematically illustrate the basic mechanical relationships that accomplish the automatic armrest movement.

FIG. 2 shows the armrest 22 having a rear portion 28 that has defined in it an armrest pivot hole 30. The pivot hole 30 receives the smooth portion of an armrest pivot pin 32, which is threaded to the base member 14. The seat back 20 has a lower end portion 36 that has defined in it a seat back pivot hole 38 for receiving the smooth portion of a seat back pivot bolt 40. The seat back pivot bolt 40 is threaded to the base member 14 at a position forward of and slightly above the armrest pivot 32 (FIG. 2).

An armrest support pin 44 is attached to the seat back lower end portion 36 at a position generally forward of and below the seat back pivot hole 38 when the seat back 20 is in the upright position (FIG. 2). The armrest 22 includes an intermediate portion 46 that is located generally forward of the pivot hole 30. The intermediate portion 46 includes a smooth, downward-facing bearing surface 48 that normally rests on the support pin 44.

The support pin 44 moves with the seat back portion 36 as that portion pivots about bolt 40. Accordingly, when the seat back 20 is moved from the upright position (FIG. 2) to the reclined position (FIG. 3), the support pin 44 rises to elevate the armrest 22 from the lowered position (FIG. 2) to the raised position (FIG. 3).

The support pin 44 is about twice as far from the armrest pivot pin 32 as it is from the seat back pivot bolt 40. Therefore, arm elevation angle is a function of seat back recline angle, with the elevation angle being about half of the recline angle.

Figure 4:
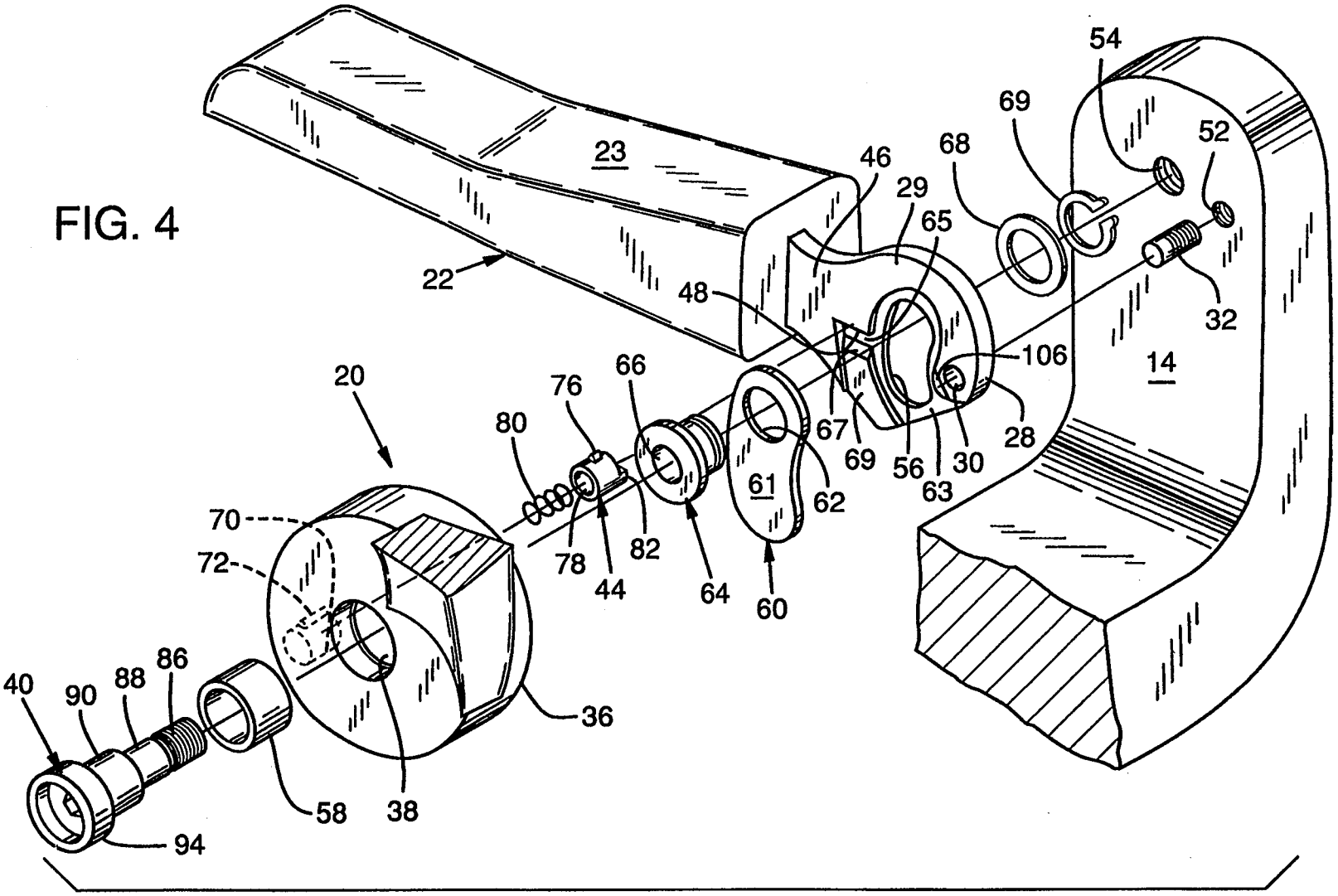
FIG. 4 is an exploded isometric view of the armrest assembly of the embodiment of FIG. 1.
Figure 6:
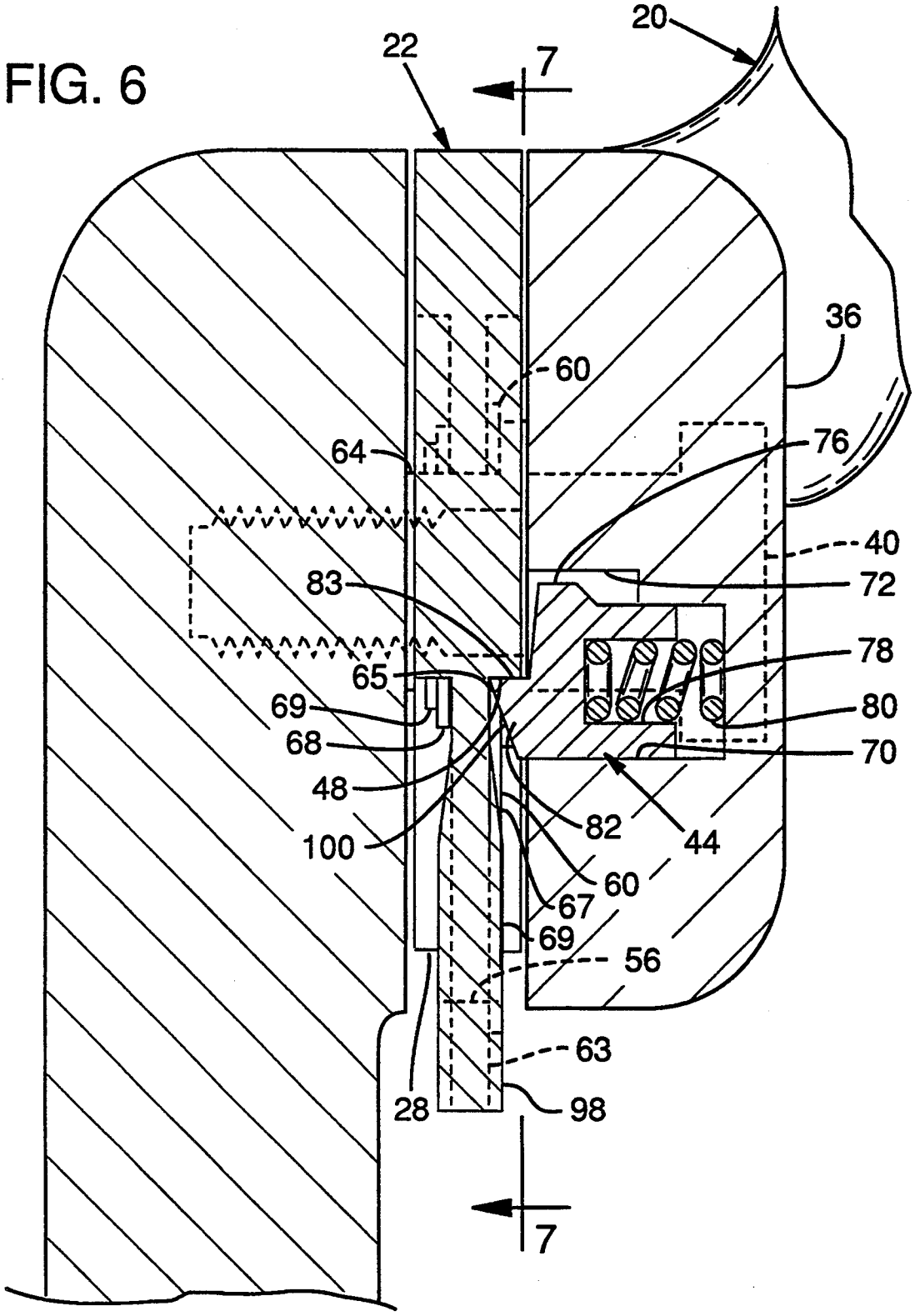
FIG. 6 is an enlarged, cross-sectional view of the armrest assembly of the embodiment of FIG. 1 taken along line 6—6 of FIG. 5.

FIG. 4 shows an exploded view of one armrest assembly. Refer, also, to FIG. 6. The base member 14 includes a threaded hole 52 for receiving the armrest pivot pin 32. The armrest pivot pin 32 has a threaded portion that is completely threaded into the hole 52 so that a smooth portion protrudes inwardly from the base member 14 by a limited amount. The base member 14 further includes a threaded hole 54 positioned forward of and above hole 52 for receiving the threaded end of the bolt 40, as described below.

The rear portion 28 and intermediate portion 46 of the armrest 22 comprise a vertical plate having a maximum thickness generally equal to the length of the inwardly protruding smooth portion of the armrest pivot pin 32. Thus, when the armrest 22 is installed, with the armrest pivot hole 30 receiving the armrest pivot pin 32, the innermost surface of pin 32 is generally flush with the inner surface 29 of the armrest rear portion 28.

The rear portion 28 includes a kidney-shaped clearance hole 56 positioned forward of the armrest pivot hole 30. The clearance hole 56 is essentially an oblong that is curved so that its long axis is centered on the armrest pivot hole 30.

The armrest inner surface 29 includes a recessed region 63 around the periphery of the clearance hole 56. A planar, kidney-shaped plastic guard plate 60 having a circular guard hole 62 through it, is sized to substantially cover the clearance hole 56 and to closely fit within the recessed region 63. The guard plate fully occupies the width of the recess 63.

The recessed region 63 is contiguous with a second recessed region 65 in the armrest surface 29. That region 65 extends forward of the clearance hole 56 and below the bearing surface 48. The inner surface 29 also includes a ramp 67 immediately below the second recessed region 65. The ramp slopes from the surface of region 65 to a plateau portion 69 raised above the surface of recessed region 65 by an amount equal to the thickness of the guard plate 60. Thus, the surface 61 of the guard plate 60 is flush with the plateau 69, with the plateau edge abutting the plate edge to permit no appreciable gap therebetween. Another ramp 106 extends between the recessed portion 63 and the surface 29 near the pivot hole 30.

With continued reference to FIGS. 4 and 6, the lower end portion 36 of the seat back 20 is generally disc-shaped and defines a central seat back pivot hole 38 which closely receives a hollow cylindrical bushing 58. The bolt 40 passes through the pivot hole 38 and the bushing 58 to provide a pivot axis for the seat back 20.

The guard plate 60 is assembled with the armrest 22 to slide over the clearance hole 56. A flanged bushing 64 extends through the guard hole 62 in the plate 60 to protrude toward the base member 14. The flanged bushing 64 has a central through-hole 66. A washer 68 is placed over the protruding end of bushing 64 on the opposite side of the armrest rear portion 28, and is secured by a snap ring 69. The bolt 40 is passed through hole 66 and threaded to base member 14, securing the bushing 64 against the base member and permitting the armrest 22 to pivot within the range permitted by the length of the clearance hole 56.

The bolt 40 includes a threaded end portion 86 and an adjacent first smooth portion 88 (FIG. 4). A second smooth shoulder portion 90 spans between the first portion 88 and a bolt head 94. When installed, the threaded portion 86 is threaded into hole 54, the first smooth portion 88 is received by the through-hole 66 of the flanged bushing 64, and the second shoulder portion 90 extends through the seat back pivot bushing 58. The bolt 40 is tightened so that the shoulder bears against the face of the flanged bushing 64, and compresses the bushing against the base member 14.

The lower end portion 36 of the seat back 20 also defines a bore 70 in the side facing the armrest 22 and base 14. The bore 70 receives the armrest support pin 44 and includes an alignment groove 72. The support pin 44 is generally cylindrical, with a diameter sized slightly less than that of the bore 70. A key 76 protrudes from an upper side of the pin 44, to be loosely retained in the alignment groove 72 to prevent the pin 44 from rotating beyond a limited range within the bore.

The support pin 44 also includes a rear pocket 78 for receiving a compression spring 80 that is captured within the bore 70 by the pin 44. The spring 80 biases the pin outward from the bore against the second recessed region 65 of the armrest surface 29. The pin 44 includes a semi-circular protruding end portion 82 having a flat upper supporting surface 83 defined by a plane intersecting the central axis of the pin 44 and perpendicular to the armrest inner surface 29.

Figure 5:
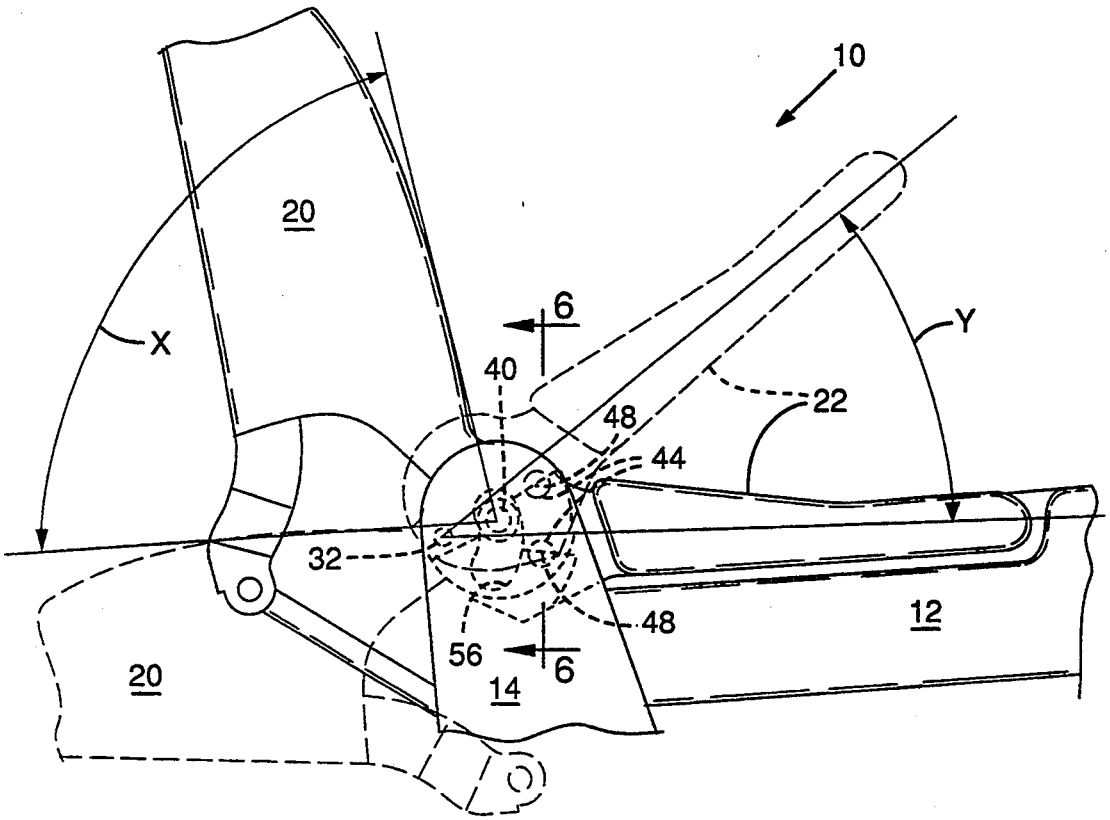
FIG. 5 is a side view of the armrest assembly of the embodiment of FIG. 1.

FIG. 5 shows the chair 10 with the seat back 20 in the upright position (solid lines) and in the reclined position (dashed lines). During normal use, the seat back moves through an angular range of motion "X" of about 80 degrees, with the extreme positions (upright and reclined) being illustrated. The armrest 22 is shown in its lowered position (solid lines) so that it is flush with the seat 12, and in its raised position (dashed lines). The armrest 22 is moved by the support pin 44, which pin rotates with the seat back about pivot bolt 40, through an angular range of motion "Y" of about 37 degrees as the seat back moves through its 80-degree range of motion. FIG. 5 further shows that the support pin 44 slides relative to the bearing surface 48 as pivoting occurs. This is due to the offset back and arm pivot axes and different radii from the respective axes to the support pin 44.

As best shown in FIG. 6, the bearing surface 48 of the armrest rests on the flat upper surface 83 of the support pin 44. The support pin end portion 82 has a sloped face 100 that forms an acute angle with the plane of the flat upper surface 83.

Figure 7:
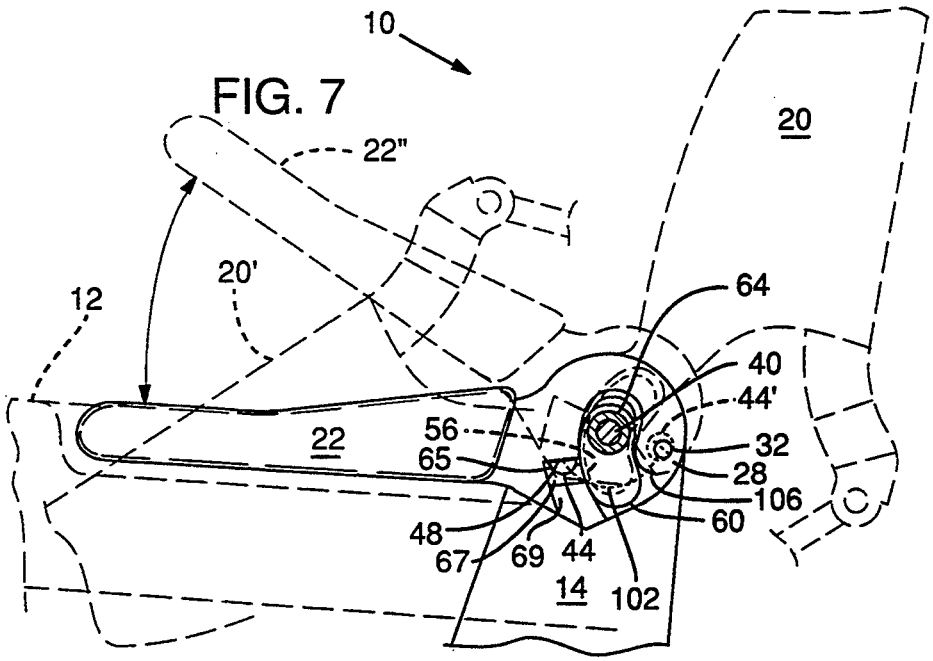
FIG. 7 is a cross-sectional view of the embodiment of FIG. 1 taken along line 7—7 of FIG. 6.

As shown in FIG. 7, the seat back 20 may be pivoted forward and downward to a folded position 20' (dashed lines) to fit in a compact shipping package. The seat 12 is generally removed for shipping. The absence of the seat 12 underlying the armrests permits the armrests 22 to be folded downward to a shipping position (not shown) that is slightly below their normal lowered position. As further folding continues after the armrests reach the shipping position, the support pin 44 moves through an arc path 102 away from the bearing surface 48, up the ramp 67 (FIG. 4), over the plateau 69, across the guard plate 60, up the second ramp 106 leading up to the surface 29 of the armrest rear portion 28, to a second support pin location 44'. The sloped front face 100 (shown in FIG. 6) of the support pin 44 serves as a cam surface that permits the pin to easily ride up and over the ramps 67, 106.

When setting up the chair after shipping, the support pin 44 follows path 102 without obstruction. Without the guard plate 60, the support pin 44 would become caught in the clearance hole 56, so that the seat back could not be raised from the folded position 20' to the upright position 20 without disassembly.

FIG. 7 further shows that the armrest 22 may be manually raised to a position 22" away from the chair while the seat back 20 is in the upright position. As the armrest is lifted, the flanged bushing 64 surrounding the seat back securing bolt 40 provides a stop against the lower end of the clearance hole 56. The support pin 44, which remains stationary as the armrest is manually lifted, slides up ramp 67, and over plateau 69. The effect of the bushing 64 stopping against the lower end of the hole 56 is to limit the upward travel of the armrest 22 and to prevent the pin 44 from sliding off the lower edge of the plateau 69 beneath the armrest.

Having illustrated and described the principles of the invention by what is presently a preferred embodiment, it should be apparent to those persons skilled in the art that the illustrated embodiment may be modified without departing from such principles. For example, the relative positions of the seat back pivot, armrest pivot, and support pin may be adjusted to provide different ranges of motion and different ratios of angular motions.

In view of the many possible embodiments to which the principles of the invention may be put, it should be recognized that the detailed embodiment is illustrative only and should not be taken as limiting the scope of the invention. Rather, we claim as the invention all such embodiments that may come within scope and spirit of the following claims and equivalents thereto.

We claim:

1. An armrest assembly for a chair comprising:

a base;

an armrest pivotally attached to the base at an armrest pivot to move through a range of motion between a raised position and a lowered position;

a seat back pivotally attached to the base at a back pivot, the seat back being movable about the back pivot through a first range of motion between a reclined position and an upright position; and a support member attached to the seat back between the seat back and the armrest away from the back pivot and having an end protruding from the seat back for contacting the armrest at a location such that movement of the seat back from the upright position to the reclined position causes the support member to move the armrest about the armrest pivot between the lowered position and the raised position, the support member being mounted to support the armrest such that the armrest may be pivoted freely about the armrest pivot relative to the support member.

2. The assembly of claim 1 wherein the support member is movable relative to the seat back in a direction away from the armrest for permitting the seat back to be moved through a second range of motion outside the first range of motion.

3. The chair of claim 2 wherein the support member is biased in a direction toward the armrest.

4. The chair of claim 3 wherein the support member includes a cam surface and wherein the armrest includes a ramp, the ramp and cam surface being shaped to engage one another for moving the support member in the direction toward and away from the armrest as the seat back is moved through part of the second range of motion.

5. The chair of claim 1 wherein the armrest defines a clearance hole, the back pivot extending through a first portion of the hole, the hole having a generally oblong shape.

6. The chair of claim 5 including a cover member substantially covering a second portion of the clearance hole, thereby to prevent the support member from moving into the hole.

7. The chair of claim 6 wherein the cover member is pivotally attached to the seat back at the seat back pivot.

8. The chair of claim 1 wherein the armrest pivot location remains stationary as the seat back is reclined and is positioned away from the position of the back pivot.

9. The chair of claim 1 wherein the support member includes a supporting surface that slidably engages the armrest when the support member contacts the armrest at the first-mentioned location, the support member sliding relative to the armrest as the seat back moves between the upright and reclined position.

10. The chair of claim 1 wherein the support member is positioned generally forward of the back pivot when the back is in the upright position.

11. The chair of claim 1 wherein the support member supports the armrest from below such that the armrest may freely be pivoted upward relative to the support member.

12. The armrest assembly of claim 1 further comprising:

a seat carried by the base and defining a seating surface upon which a patient sits; and the armrest having a top surface that is generally flush with the seating surface when the armrest is in the lowered position.

13. The armrest assembly of claim 12 wherein the seat also defines a recess sized for receiving the armrest in the lowered position.

14. An armrest assembly for a dental chair comprising:

a base;

an armrest pivotally attached to the base at an armrest pivot to move through a range of motion between a raised position and a lowered position;

a seat back pivotally attached to the base at a back pivot, the seat back being movable about the back pivot through a first range of motion between a reclined position and an upright position;

a support member attached to the seat back and away from the back pivot and having a surface against which the armrest is supported for sliding motion relative to the surface; and an armrest-actuating means for moving the armrest toward the raised position in response to movement of the seat back toward the reclined position, and for permitting movement of the armrest toward the lowered position in response to movement of the seat back toward the upright position wherein the armrest-actuating means moves the armrest at a first angular rate in response to movement of the seat back at a second angular rate, the second angular rate being greater than the first angular rate.

15. The assembly of claim 14 wherein the first angular rate is less than half the second angular rate through at least a portion of the ranges of motion of the armrest and seat back, such that the armrest elevates by only a limited amount when the seat back reclines a substantial amount.

16. The chair of claim 14 wherein the armrest actuating means comprises a support member attached to the seat back and spaced apart from the back pivot.

17. The chair of claim 14 including clearance means attached to the armrest for permitting the seat back to be folded forward of the upright position to a folded position and for preventing the armrest actuating means from interfering with the armrest when the seat back is returned from the folded position toward the upright position.

18. The chair of claim 14 including a seat attached to the base, the armrest being aligned with the seat when in the lowered position such that the armrest does not obstruct entry of a patient into the chair when the seat back is in the upright position.

19. The armrest assembly of claim 14 further comprising:

a seat carried by the base and defining a seating surface upon which a patient sits; and the armrest having a top surface that is generally flush with the seating surface when the armrest is in the lowered position.

* * * * *